US005218906A

United States Patent [19]

Doersam

[11] Patent Number: 5,218,906

[45] Date of Patent: Jun. 15, 1993

[54] CYLINDER BLANKET FASTENING ASSEMBLY

[75] Inventor: Willi R. L. Doersam, Hoechberg, Fed. Rep. of Germany

[73] Assignee: Koenig & Bauer Aktiengesellschaft, Wurzburg, Fed. Rep. of Germany

[21] Appl. No.: 897,817

[22] Filed: Jun. 12, 1992

[30] Foreign Application Priority Data

Jun. 15, 1991 [DE] Fed. Rep. of Germany ..... 4113823

[51] Int. Cl.[5] ..... B41F 27/06

[52] U.S. Cl. ..... 101/378; 101/415.1; 101/383

[58] Field of Search ..... 101/378, 415.1, 383, 101/384

[56] References Cited

U.S. PATENT DOCUMENTS 3,168,040 7/1962 Norton ..... 101/415.1
3,757,690 11/1973 Skiera et al. ..... 101/378
4,009,659 3/1977 Schneider ..... 101/378
4,426,431 1/1984 Vogt ..... 101/415.1
4,813,356 3/1989 Abendroth et al. ..... 101/415.1

FOREIGN PATENT DOCUMENTS 1145185 3/1961 Fed. Rep. of Germany .
1348679 1/1963 France ..... 101/378
128886 12/1976 German Democratic Rep. .
62-21547 1/1987 Japan .

*Primary Examiner*—Edgar S. Burr
*Assistant Examiner*—Anthony H. Nguyen
*Attorney, Agent, or Firm*—Jones, Tullar & Cooper

[57] ABSTRACT

A cylinder blanket fastening assembly utilizes a resilient clamping bar that is secured to a channel edge of a cylinder and generally adjacent a tensioning shaft carried in a channel in the cylinder. A leading edge of an inner blanket is positionable between a clamping edge of the clamping bar and the channel edge. The clamping bar is moved into clamping position by rotation of the tensioning shaft.

5 Claims, 2 Drawing Sheets

CYLINDER BLANKET FASTENING ASSEMBLY

FIELD OF THE INVENTION

The present invention is directed generally to a cylinder blanket fastening assembly. More particularly, the present invention is directed to a device for fastening blankets to transfer or offset cylinders of rotary printing presses. Most specifically, the present invention is directed to a cylinder blanket fastening assembly for the separate fastening of the lowest or inner layer or layers of a multi-layer blanket or dressing to a cylinder. The lowest or inner layer, which is typically a shim or spacer, is secured to the cylinder by insertion of its leading edge beneath a clamping edge of a clamping bar which is attached to an edge portion of a channel which receives the blanket tensioning shaft. Rotation of the blanket tensioning shaft during securement of the blanket to the cylinder causes the clamping bar to shift so that its clamping edge firmly engages the leading end of the backing sheet or shim sheet which is being secured beneath the blanket.

DESCRIPTION OF THE PRIOR ART

It is generally known in the art to utilize one or more layers of a thin material, such as layers of paper, beneath the rubber sheets or blankets that are secured to the outer surfaces of blanket cylinders in rotary printing machines. These thin paper layers act as shims or spacers and adjust the overall diameter of the blanket or offset cylinder to the diameter of the bearer rings in accordance with the thickness of the blanket that is being applied to the surface of the transfer or offset cylinder.

One prior art assembly that is usable in the securement of these inner or lowest paper layers to the surface of a transfer or offset cylinder is shown in East German Letters Patent No. DD-WP 128 886. In this device, the lowest or innermost blanket layer is clamped against a lateral face of the cylinder tightening channel by the use of a trapezoidal bar that is pushed radially outwardly against the lateral face of the channel by a compression spring. In this prior art device, it is necessary to tighten the trapezoidal bar by using a wrench which must be inserted radially inwardly into the clamping channel.

Another prior art device that is also used to secure a multiple layer dressing or covering to the surface of a cylinder is shown in German Published Examined Patent Application DE-AS 1145 185. In this prior art device, the lowest or inner layer of the blanket is guided in a channel that is formed between a tensioning bar and a chamber-like recess in the printing cylinder. The inner or lowest layer of the dressing or covering for the cylinder is clamped between the tensioning bar and the chamber wall by turning the tension bar which is provided with suitable clamping faces. In this prior art device, as was the case with the previously discussed prior art device, a tool is required to turn or rotate the tensioning bar. A additional limitation of this prior art device is that during the engagement of the lowest or innermost dressing or covering layer against the chamber wall, that because of the pressure of the clamping faces of the tensioning bar that the sheet on the lowest or innermost layer of the cover or dressing may be shifted or displaced. Such a disruption of the blanket inner layer will have a detrimental effect on the usefulness of the blanket applied to the cylinder since a shifting in the inner layer may make the overall diameter of the cylinder incorrect.

It will thus be apparent that a need exists for a cylinder blanket fastening assembly that does not require special tools and which is effective in properly and securely attaching the inner covering to the cylinder. The cylinder blanket fastening assembly, as will be discussed in detail shortly, provides such a device.

SUMMARY OF THE INVENTION

It is an object of the present invention to provide a cylinder blanket fastening assembly.

Another object of the present invention is to provide a device for fastening blankets on transfer or offset cylinders of rotary printing presses.

A further object of the present invention is to provide a cylinder blanket fastening assembly for the separate fastening of the lowest or innermost layer of a multi-layer blanket to a cylinder.

Yet another object of the present invention is to provide a cylinder blanket fastening assembly that secures the inner blanket to the cylinder when the upper or outer blanket layer is tightened.

Still a further object of the present invention is to provide a cylinder blanket fastening assembly which does not require the use of additional tools to secure the inner blanket to the cylinder.

As will be discussed in greater detail in the description of the preferred embodiment which is set forth subsequently, the cylinder blanket fastening assembly in accordance with the present invention utilizes a clamping bar that is attached to an edge portion of a channel in the cylinder and adjacent a rotatable tensioning shaft which is used to secure the outer or upper blanket to the cylinder. The clamping bar is somewhat L-shaped in cross-section and is pivotably secured to the channel edge. As the tensioning shaft is rotated, an edge of an axially extending, radially directed slot in the tensioning shaft engages one leg of the clamping bar and pivots the clamping bar so that a second leg of the clamping bar, which has a clamping edge, is pivoted into clamping engagement with the leading edge of an inner blanket that has been inserted between the clamping edge and the channel edge.

A particular advantage of the cylinder blanket fastening assembly of the present invention lies in the fact that the automatic and positive clamping of the inner backing sheet or sheets for the outer blanket takes place during the tightening of the blanket on the cylinder. No additional operational steps or additional tools ar required. Due to the structure of the blanket fastening assembly of the present invention, the inner layer or layers are positively held in place and cannot slide or be displaced. This means that the inner sheet or sheets will be attached properly to the cylinder and will not result in a cylinder with an uneven outer surface.

The clamping bar of the cylinder blanket fastening assembly has a reinforcing element which extends along parallel to the clamping edge. This insures that the clamping force exerted by the clamping edge will be uniform along the length of the edge. The provision of the reinforcement also means that the control edge portion of the clamping bar will uniformly contact the slit edge and the peripheral surface of the rotatable tensioning shaft.

The clamping bar is provided with spaced, radially extending slits adjacent its ends. These slits increase the spring action of the clamping bar and again insure that the clamping forces applied by the clamping bar will be uniform and adequate.

The cylinder blanket fastening assembly in accordance with the present invention overcomes the limitations of the prior art devices and provides a device which positively and securely attaches an inner blanket or thin sheet to a cylinder. It provides a substantial advance over the prior art devices.

BRIEF DESCRIPTION OF THE DRAWINGS

While the novel features of the cylinder blanket fastening assembly in accordance with the present invention are set forth with particularity in the appended claims, a full and complete understanding of the invention may be had by referring to the detailed description of the preferred embodiment, which is set forth subsequently, and as illustrated in the accompanying drawings, in which:

DESCRIPTION OF THE PREFERRED EMBODIMENT

Figure 1:
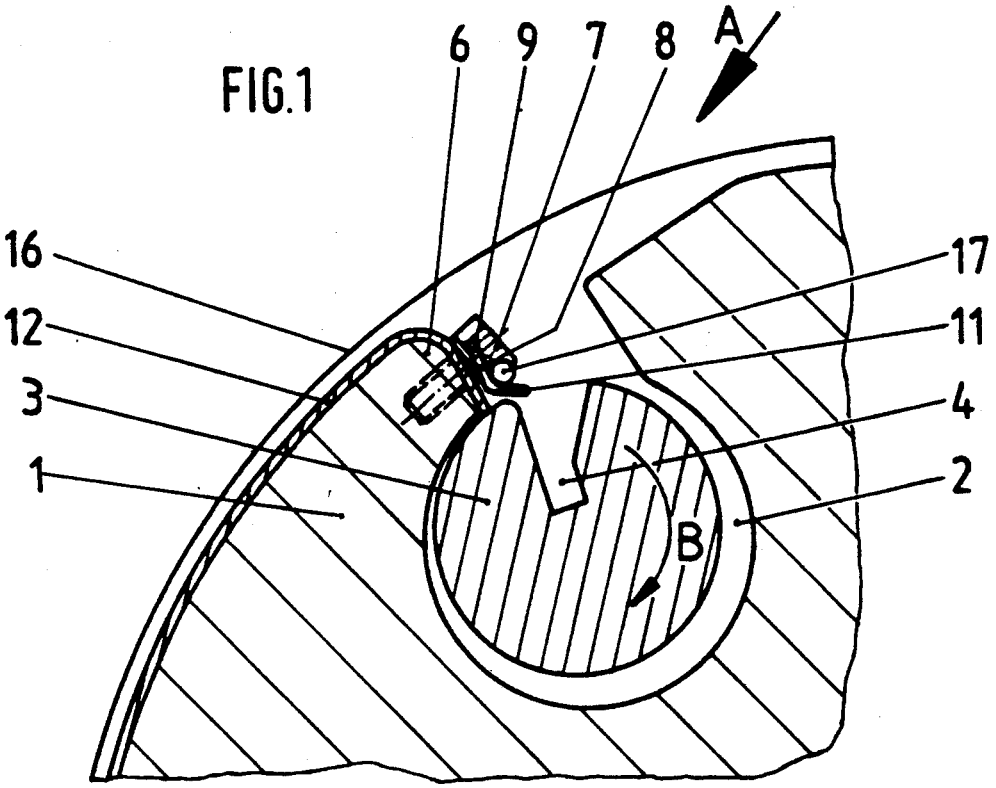
FIG. 1 is a cross-sectional view of a portion of an offset cylinder provided with a cylinder blanket fastening assembly in accordance with the present invention and showing the insertion of an inner sheet or blanket into the fastening assembly.
Figure 3:
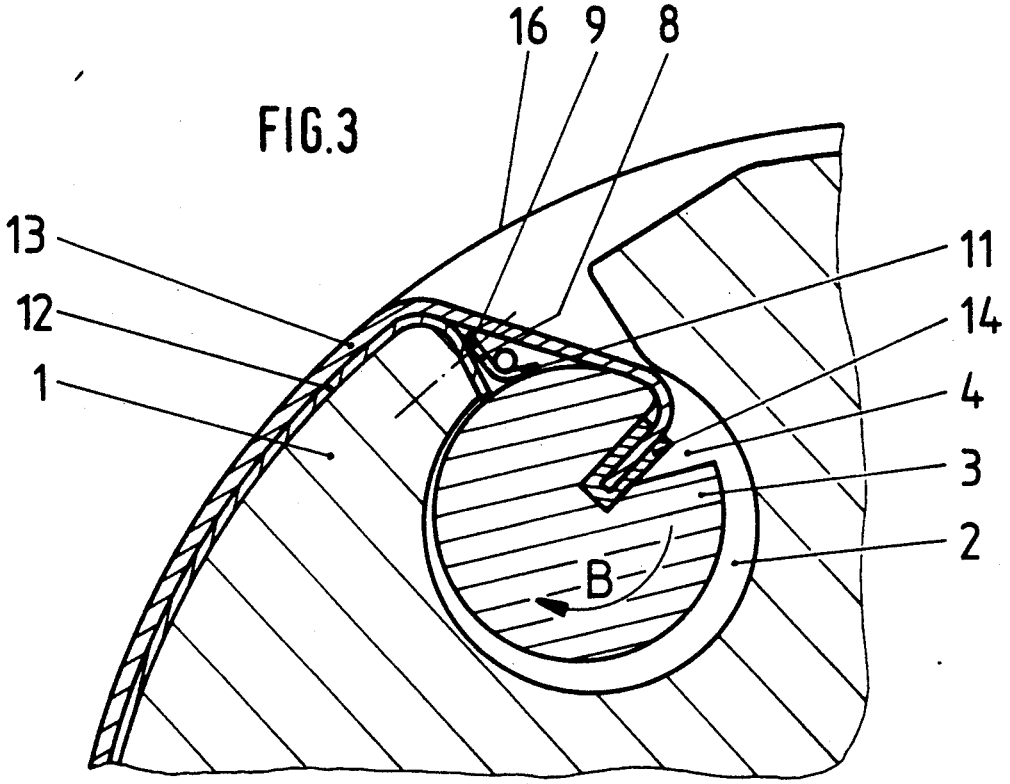
FIG. 3 is a view generally similar to FIGS. 1 and 2 and showing the clamping of the inner sheet and the tensioning of the outer cylinder blanket.

Referring initially to FIG. 1, there may be seen a preferred embodiment of a cylinder blanket fastening assembly in accordance with the present invention. An offset cylinder of a sheet fed offset printing press is shown at 1 in FIG. 1. It will be understood that this is a cross-sectional view of only a portion of offset or transfer cylinder 1 and that this cylinder is rotatably supported between suitable frames or end assemblies that are not specifically shown. A channel 2 extends parallel to the central shaft (not shown) of offset cylinder 1. This channel 2 carries a generally conventional tensioning shaft 3 that is provided with an axially extending, radially slot 4. In conventional use, the leading end of a blanket 13 has a bar 14 which is insertable into slot 4, as seen in FIG. 3. The tensioning shaft 3 is then turned in the channel 2 in the direction indicated by arrow B to tension the blanket 13 on the outer surface of the offset cylinder 1.

Figure 4:
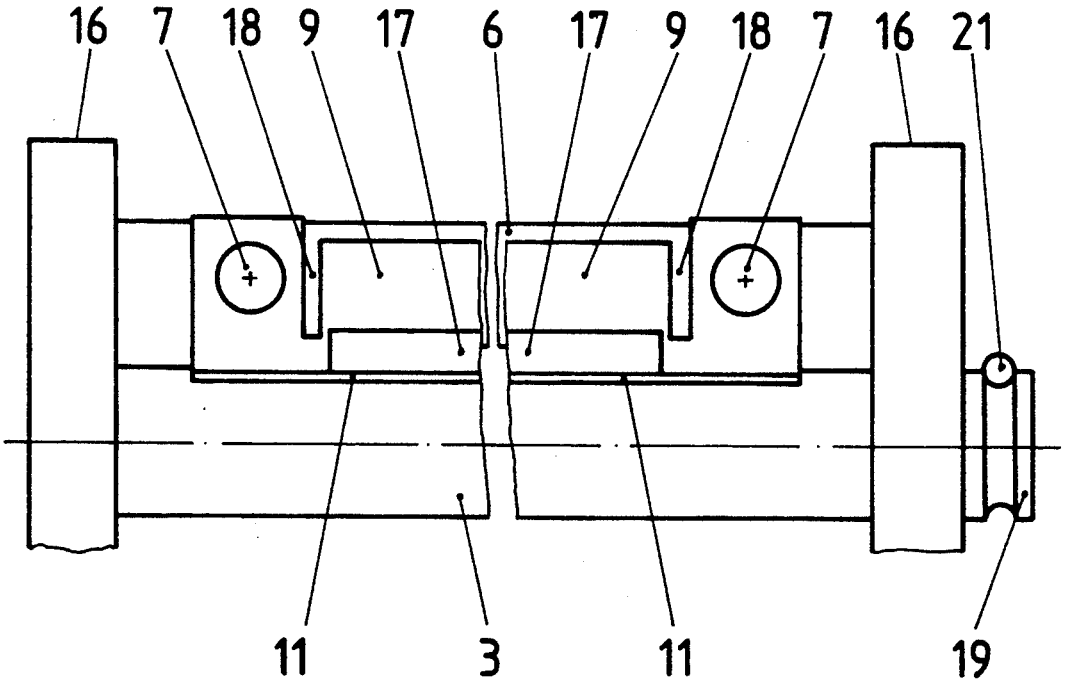
FIG. 4 is a plan view of the cylinder blanket fastening assembly of the present invention taken in the direction indicated by the arrow A in FIG. 1.

In accordance with the present invention, a clamping bar 8 is attached to a channel edge 6 of the channel 2 by the use of suitable fastening screws 7, as shown in FIGS. 1 and 4. Clamping bar 8 is somewhat L-shaped in cross-section and has a clamping edge 9 which extends parallel to the channel edge 6. The clamping edge 9 is provided at the free end of a first leg of the clamping bar 8. A free end of a second leg of the clamping bar 8 provides a control edge 11. This control edge 11 extends generally tangentially to the tensioning shaft 3. The angle between the first and second legs of the generally L-shaped clamping bar 8 is slightly more than 90° and the clamping bar 8 is made of a resilient material.

As may be seen most clearly in FIG. 4, the screws 7 used to attach the clamping bar 8 to the channel edge 6 are positioned at the axial ends of the clamping bar 8. Axially inwardly of these screws, the first leg of the clamping bar 8; i.e. the leg which engages the channel edge 6 is provided with spaced, radially extending slits 18. These slits 18 enhance the resiliency of the clamping bar 8. The bar 8 is also provided with a generally cylindrical or tube-shaped reinforcement 17 which is placed at the juncture of the two legs that form the L-shape of the clamping bar. This reinforcement section 17 may have a pipe-shaped cross-section. As may also be seen in FIG. 4, one end of the clamping or tensioning shaft 3 is provided with a central drive, which may consist of a worm wheel or gear 19 that is engaged by a worm shaft 21. Rotation of the worm shaft 21 will cause the worm gear 19 to turn so that the tensioning shaft 3 can be turned.

Figure 2:
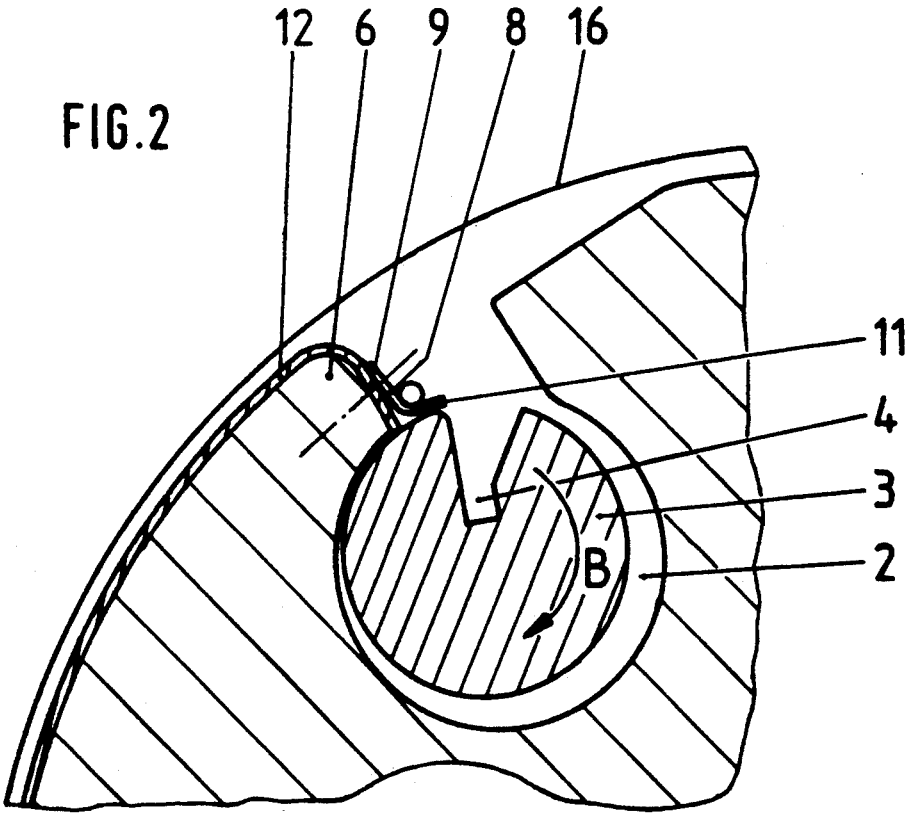
FIG. 2 is a view similar to FIG. 1 and showing the clamping of the inner backing sheet.

Turning now again to FIG. 1 and also referring to FIG. 2, a backing sheet 12 which may be one or several thin sheets and which is to be the inner sheet or shim beneath the blanket, has a leading edge that is inserted between the channel edge 6 and the clamping edge 9 of the clamping bar 8. As depicted in FIG. 1, the control edge 11 of the clamping bar 8 has not engaged the surface of the tensioning shaft 3 adjacent the shaft slot 4. Thus the leading edge of the backing sheet 12 is easily insertable between the channel edge 6 and the clamping edge 9. Once the leading edge of the backing sheet 12 has been so positioned, rotation of the tensioning shaft 3, as depicted in FIG. 2, will cause the control edge 11 of the clamping bar 8 to contact the surface of the tensioning bar 3 adjacent its slot 4. This will pivot the clamping bar 8 so that its clamping edge 9 firmly engages the leading edge of the inner sheet 12. In FIG. 2, as well as in FIG. 3, which will be discussed hereinafter, the screw 7 has been omitted for clarity of illustration.

It will be understood that in use, an outer blanket 13 is applied to the surface of the offset or transfer cylinder concurrently with the application of the backing sheet 12. This is shown in FIG. 3. The leading end of the blanket carries a bar 14 which is insertable into the tensioning shaft slot 4. At the same time that this is done, the leading end of the backing sheet 12 is placed between the channel edge 6 and the clamping edge 9 of the clamping bar 8, as was discussed above. As the tensioning shaft 3 is turned through about 90° in the direction indicated by arrow B, with such a rotation being shown in FIG. 3 in relation to FIG. 2, the outer blanket 13 has been tightened on the cylinder 1. At the same time, the leading edge of the inner blanket 12 has been clamped in place by the clamping bar 8 without the use of separate or additional tools. As discussed previously, the combined thicknesses of the backing sheet or sheets 12 and the blanket 13 are adapted to the diameter of the cylinder bearer ring 16. The leading end of the blanket 13 is placed around the circumference of the offset or similar cylinder 1, not shown in its entirety. The trailing edge of the blanket 13 is clamped in place by means of a second tensioning shaft which is arranged generally at 280° with respect to the first tensioning shaft 3. A separate clamping bar for the lower blanket support is not required.

While a preferred embodiment of a cylinder blanket fastening assembly in accordance with the present invention has been set forth fully and completely hereinabove, it will be apparent to one of skill in the art that a number of changes in, for example, the size of the offset cylinder, the type of blanket used, the use of the assembly in other presses such as rotary offset presses, and the like may be made without departing from the true spirit and scope of the present invention which is accordingly to be limited only by the following claims.

What is claimed is:

1. A cylinder blanket fastening assembly usable to secure both lower layers and upper layers of multiple layer blankets to a peripheral surface of a cylinder, said cylinder blanket fastening assembly comprising:

a cylinder, said cylinder having a clamping channel formed adjacent a peripheral surface of said cylinder;

a clamping channel edge, said clamping channel edge being a portion of said clamping channel;

a blanket tensioning shaft rotatably disposed in said clamping channel;

an axially extending, radially directed slot in said tensioning shaft, said slot adapted to secure an end of the upper layer of the multiple layer blanket; and a generally L-shaped clamping bar having a first leg with a clamping edge and a second leg with a control edge pivotably secured to said clamping channel edge, said control edge extending into said slot in said tensioning shaft and being engageable with a peripheral surface of said tensioning shaft upon rotation of said tensioning shaft, said clamping edge being engagable with a leading edge of the lower layer of the multiple layer blanket.

2. The cylinder blanket fastening assembly of claim 1 further including a reinforcement section secured to said clamping bar generally at a point of intersection of said first and second legs and extending along the length of said clamping bar.

3. The cylinder blanket fastening assembly of claim 2 wherein said reinforcement section is generally cylindrical.

4. The cylinder blanket fastening assembly of claim 1 wherein said clamping bar is secured to said clamping channel edge by spaced screws passing through said clamping edge.

5. The cylinder blanket fastening assembly of claim 1 wherein said clamping bar has axially spaced, radially extending slits in said clamping edge.

* * * * *